US005272885A

United States Patent [19]

Watanabe

[11] Patent Number: 5,272,885

[45] Date of Patent: Dec. 28, 1993

[54] AIR-CONDITIONING APPARATUS HAVING HEAT SOURCE UNIT AND PLURAL INDOOR UNITS CONNECTED TO THE HEAT SOURCE UNIT

[75] Inventor: Shigeki Watanabe, Fujinomiya, Japan

[73] Assignee: Kabushiki Kaisha Toshiba, Kawasaki, Japan

[21] Appl. No.: 4,274

[22] Filed: Jan. 14, 1993

[30] Foreign Application Priority Data

Mar. 16, 1992 [JP] Japan ..... 4-058208

[51] Int. Cl.[5] ..... F25B 31/00

[52] U.S. Cl. ..... 62/184; 62/197; 62/505

[58] Field of Search ..... 62/197, 184, 505

[56] References Cited

U.S. PATENT DOCUMENTS 4,878,355 11/1989 Beckey et al. ..... 62/505 X
5,052,189 10/1991 Aklike ..... 62/197

FOREIGN PATENT DOCUMENTS 54-685 1/1979 Japan .
64-6657 1/1989 Japan .

*Primary Examiner*—William E. Wayner
*Attorney, Agent, or Firm*—Cushman, Darby & Cushman

[57] ABSTRACT

There is provided an air-conditioning apparatus. A cooling bypass extends from a pipe portion between a water heat exchanger and indoor heat exchangers of a refrigerating cycle to a low-pressure-side pipe portion of the refrigerating cycle. The cooling bypass is provided with a flow control valve. A discharged-refrigerant temperature Td and sucked-refrigerant temperature Ts of a compressor are sensed, and the opening degree of the flow control valve is zone-controlled in accordance with temperature Td or temperature Ts. When the sucked-refrigerant temperature Ts exceeds a predetermined value despite the zone-control, the opening degree of the flow control valve is controlled and increased. By this control, the amount of refrigerant flowing through the cooling bypass increases, and the refrigerant cooling effect on the low pressure side is enhanced.

10 Claims, 9 Drawing Sheets

AIR-CONDITIONING APPARATUS HAVING HEAT SOURCE UNIT AND PLURAL INDOOR UNITS CONNECTED TO THE HEAT SOURCE UNIT

BACKGROUND OF THE INVENTION

1. Field of the Invention

The present invention relates to a multiple air-conditioning apparatus having a heat source unit and a plurality of indoor units connected to the heat source unit.

2. Description of the Related Art

In a multiple air-conditioning apparatus wherein a heat source unit is connected to indoor units, the heat source unit comprises a compressor, a four-way valve and a heat-source-side heat exchanger, and each of the indoor units comprises an indoor heat exchanger. The compressor, four-way valve, heat-source-side heat exchanger, and indoor units are successively connected by means of pipes, thereby constituting a heat-pump type refrigerating cycle.

When the compressor is driven and the four-way valve is set in the neutral position, a refrigerant discharged from the compressor flows to the heat-source-side heat exchanger via the four-way valve, and the refrigerant coming out of the heat-source-side heat exchanger returns to the compressor via the indoor heat exchangers and the four-way valve. In this case, the heat-source-side heat exchanger functions as a condenser and the indoor heat exchangers function as evaporators, thereby performing a cooling operation.

When the compressor is driven and the four-way valve is switched, a refrigerant discharged from the compressor flows to the indoor heat exchangers via the four-way valve, and the refrigerant coming out of the indoor heat exchangers returns to the compressor via the heat-source-side heat exchanger and the four-way valve. In this case, the indoor heat exchangers function as condensers and the heat-source-side heat exchanger functions as an evaporator, thereby performing a heating operation.

Examples of the multiple air-conditioning apparatus are disclosed in Published Unexamined Japanese Patent Application (PUJPA) No. 64-6657 and Published Examined Japanese Utility Model Application (PEJUMA) No. 54-685.

PUJPA No. 64-6657 discloses an air-conditioning apparatus wherein indoor units are connected to an outdoor unit. The outdoor unit comprises a compressor, a four-way valve and outdoor heat exchangers, and each of the indoor units comprises an indoor heat exchanger. The compressor, four-way valve, outdoor heat exchangers and indoor heat exchangers are successively connected by means of pipes, thereby constituting a heat-pump type refrigerating cycle. In this air-conditioning apparatus, the capacity of each outdoor heat exchanger is controlled in accordance with the air-conditioning load of each indoor unit.

PEJUMA No. 54-685 discloses an air-conditioning apparatus wherein indoor units are connected to an outdoor unit. The outdoor unit comprises a compressor, a four-way valve and a water heat exchanger, and each indoor unit comprises a heat exchanger. The compressor (1), four-way valve, water heat exchanger and indoor heat exchangers are connected by means of pipes, thereby constituting a heat-pump type refrigerating cycle. In this air-conditioning apparatus, cool water is supplied to the water heat exchanger in the cooling operation mode, and hot water is supplied to the water heat exchanger in the heating operation mode.

In general, the refrigerating cycle is provided with a high-pressure switch which operates at the time of abnormal increase in high-pressure-side pressure. Once the high-pressure switch is operated, the operation of the compressor is stopped, thereby protecting the components of the refrigerating cycle, including the compressor.

The multiple air-conditioning apparatus is provided with two or more indoor units, and the temperature of the refrigerant returning from the indoor units to the heat source unit tends to increase in the cooling operation mode. In particular, when the air-conditioning load of each indoor unit is large, the temperature of the refrigerant sucked in the compressor may reach 40° C. If such high-temperature refrigerant is constantly sucked in the compressor, the compressor may be damaged.

In order to avoid the damage of the compressor, a protection device is provided on the low-pressure-side of the refrigerating cycle. This protection device stops the operation of the compressor when the temperature of the refrigerant sucked in the compressor exceeds a predetermined level for a predetermined time period.

In the meantime, the operation of the high-pressure switch and protection device interrupts the air-conditioning operation, and this is not desirable in maintaining comfortable air-conditioning. It is desirable, therefore, that the high-pressure switch and the protection device be not operated, if possible.

SUMMARY OF THE INVENTION

The object of the present invention is to provide an air-conditioning apparatus wherein an abnormal increase in high-pressure-side pressure can surely be prevented, an increase in sucked-refrigerant temperature of a compressor can sufficiently be controlled, and actuation of a high-pressure switch and a protection device is avoided as much as possible, thereby achieving comfortable air-conditioning.

According to the invention, there is provided an air-conditioning apparatus wherein a plurality of indoor units are connected to a heat source unit, the apparatus comprising:

a compressor, provided in the heat source unit, for sucking and compressing a refrigerant and discharging the compressed refrigerant;

a heat-source-side heat exchanger provided in the heat source unit;

a plurality of indoor heat exchangers provided in the indoor units, respectively;

a refrigerating cycle constituted by connecting the compressor, the heat-source-side heat exchanger and the indoor heat exchangers by means of pipes;

a bypass extending from a pipe portion between the heat-source-side heat exchanger and the indoor heat exchangers of the refrigerating cycle to a low-pressure-side pipe portion of the refrigerating cycle;

a flow control valve having an opening degree varied to control the amount of the refrigerant flowing in the bypass;

first temperature sensing means for sensing the temperature of the refrigerant discharged from the compressor;

second temperature sensing means for sensing the temperature of the refrigerant sucked in the compressor;

first control means for controlling the opening degree of the flow control valve in accordance with one of the sensed temperature of the first temperature sensing means and the sensed temperature of the second temperature sensing means; and second control mean for controlling the opening degree of the flow control valve by increasing the opening degree of the flow control valve, when the sensed temperature of the second temperature sensing means exceeds a predetermined value, despite the control by the first control means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
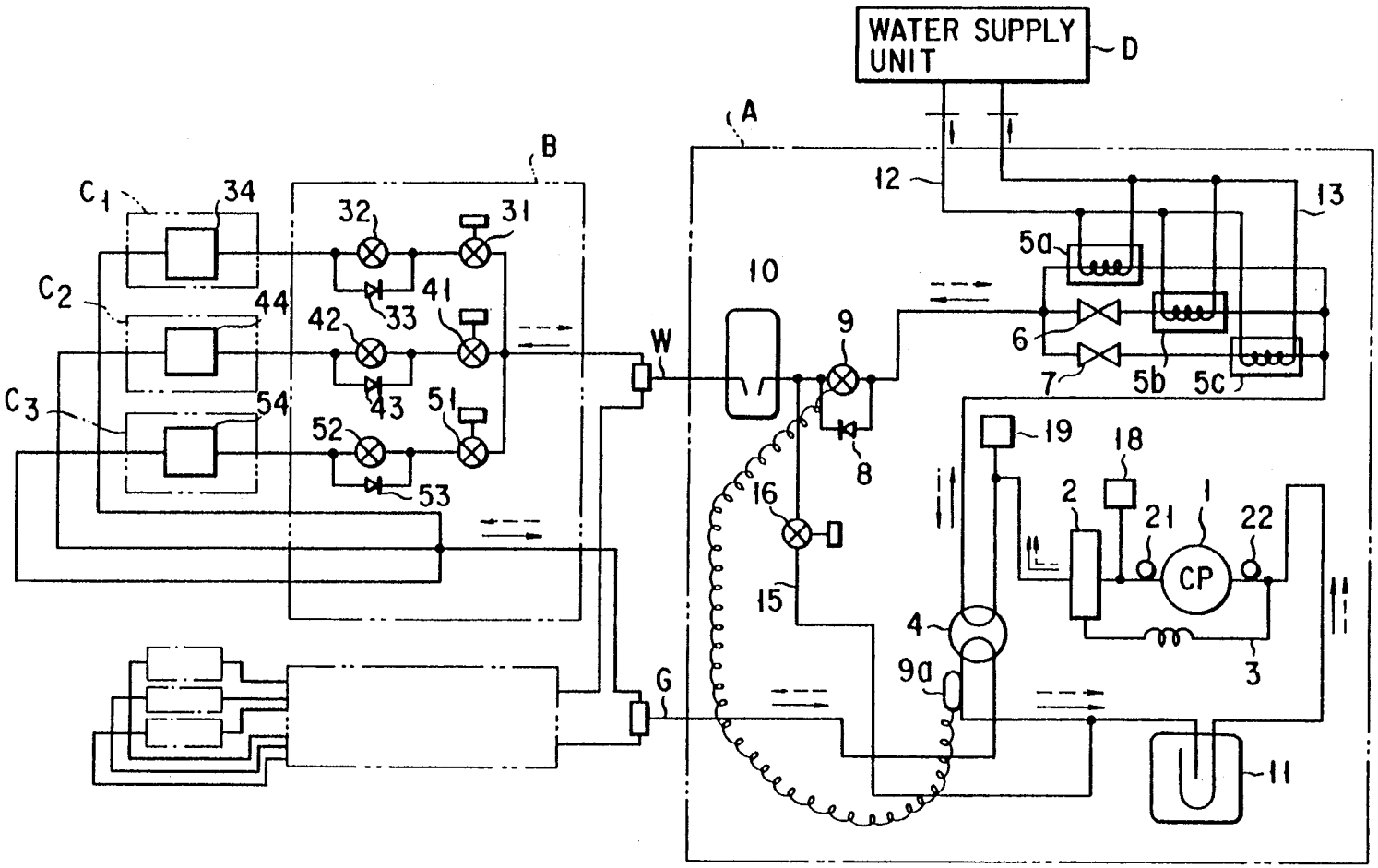
FIG. 1 shows the structure of a refrigerating cycle according to a embodiment of the present invention.

An embodiment of the present invention will now be described with reference to the accompanying drawings.

An outdoor unit A is connected to a distribution unit B. The distribution unit B is connected to indoor units $C_1$, $C_2$ and $C_3$.

The units A, B, $C_1$, $C_2$ and $C_3$ constitute a heat-pump type refrigerating cycle.

The outdoor unit A has a variable-capability compressor 1. The compressor 1 sucks and compresses a refrigerant from a suction port and discharges it from a discharge port.

An oil separator 2 is connected to the discharge port of the compressor 1. An oil bypass 3 is connected between the oil separator 2 and the suction port of the compressor 1.

Heat-source-side heat exchangers, e.g. water heat exchangers 5*a*, 5*b* and 5*c*, are connected to the oil separator 2 via an electromagnetic four-way valve 4. The four-way valve 4 functions to switch the direction of flow of refrigerant. When electric power is not supplied to the valve 4, the valve 4 is set in the neutral position. Upon receiving electric power, the valve 4 changes the direction of refrigerant flow. The water heat exchangers 5*a*, 5*b* and 5*c* function to exchange heat of the incoming refrigerant with heat of water supplied from a water supply unit D (described later). Each water heat exchanger 5*a*, 5*b*, 5*c* has a double-pipe structure in which a pipe for passing refrigerant and a pipe for water are coaxially arranged. Specifically, the double-pipe structure achieves highly efficient heat exchange between refrigerant and water.

The water heat exchangers 5*a*, 5*b* and 5*c* are situated in parallel, and electromagnetic two-way valves 6 and 7 are provided midway along pipes communicating with the water heat exchangers 5*b* and 5*c*.

A receiver 10 is connected to the water heat exchangers 5*a*, 5*b* and 5*c* via a forward check valve 8. An expansion valve 9 used in the heating operation is connected in parallel to the check valve 8.

The expansion valve 9 has a temperature sensing portion 9*a* for sensing the temperature of refrigerant, and the opening degree of the expansion valve 9 is varied in accordance with the difference between the temperature of the incoming refrigerant and the sensed temperature of the temperature sensing portion 9*a*. The temperature sensing portion 9*a* is provided on a low-pressure-side pipe between the four-way valve 4 and an accumulator 11 (described later). Specifically, the opening degree of the expansion valve 9 varies in accordance with the difference between the temperature of the incoming refrigerant and the temperature of refrigerant sucked in the compressor 1.

The receiver 10 is connected to indoor heat exchangers 34, 44 and 54 of the indoor units $C_1$, $C_2$ and $C_3$ via flow control valves 31, 41 and 51 and expansion valves 32, 42 and 52 for the cooling operation. Check valves 33, 43 and 53 are connected in parallel to the expansion valves 32, 42 and 52.

A liquid line W for passing a liquid refrigerant extends between the water heat exchangers 5*a*, 5*b* and 5*c* and the indoor heat exchangers 34, 44 and 54. The flow control valves 31, 41 and 51 are pulse motor valves (PMV), each having the opening degree which is variable in accordance with the number of supplied driver pulsed. The indoor heat exchangers 34, 44 and 54 function to exchange heat of the incoming refrigerant with heat of the indoor air.

The suction port of the compressor 1 is connected to the indoor heat exchangers 34, 44 and 54 via the four-way valve 4 and accumulator 11.

A low-pressure-side gas line G for passing gas-phase refrigerant extends between the indoor heat exchangers 34, 44 and 54 and the suction port of the compressor 1.

One end of a cooling bypass 15 is connected to the liquid line W extending between the check valve 8 and the receiver 10. The other end of the bypass 15 is connected to the gas line G extending between the four-way valve 4 and accumulator 11 on the downstream side of the temperature sensing portion 9*a*. A flow control valve 16 is provided midway along the bypass 15.

The flow control valve 16 is a pulse motor valve (PMV) having the opening degree which is variable in accordance with the number of supplied driver pulses.

A high-pressure switch 18 is provided between the discharge port of the compressor 1 and the oil separator 2. The high-pressure switch 18 operates when the high-pressure-side pressure Pd increases abnormally and exceeds a preset value. A pressure sensor 19 is provided on a high-pressure-side pipe between the oil separator 2 and the four-way valve 4. The pressure sensor 19 senses the high-pressure-side pressure Pd.

A temperature sensor 21 functioning as first temperature sensing means is provided between the discharge port of the compressor 51 and the oil separator 2. The temperature sensor 21 senses the temperature Td of refrigerant discharged from the compressor 1. A temperature sensor 22 functioning as second temperature sensing means is provided between the accumulator 11 and the suction port of the compressor 1. The temperature sensor 22 senses the temperature Ts of refrigerant sucked by the compressor 1.

On the other hand, the water supply unit D is connected to the water heat exchangers 5*a*, 5*b* and 5*c* via water pipes 12 and 13. Specifically, water is supplied from the water supply unit D to the water heat exchangers 5*a*, 5*b* and 5*c* via the pipe 12, and the water is returned from the water heat exchangers 5*a*, 5*b* and 5*c* to the water supply unit D via the pipe 13.

Figure 2:
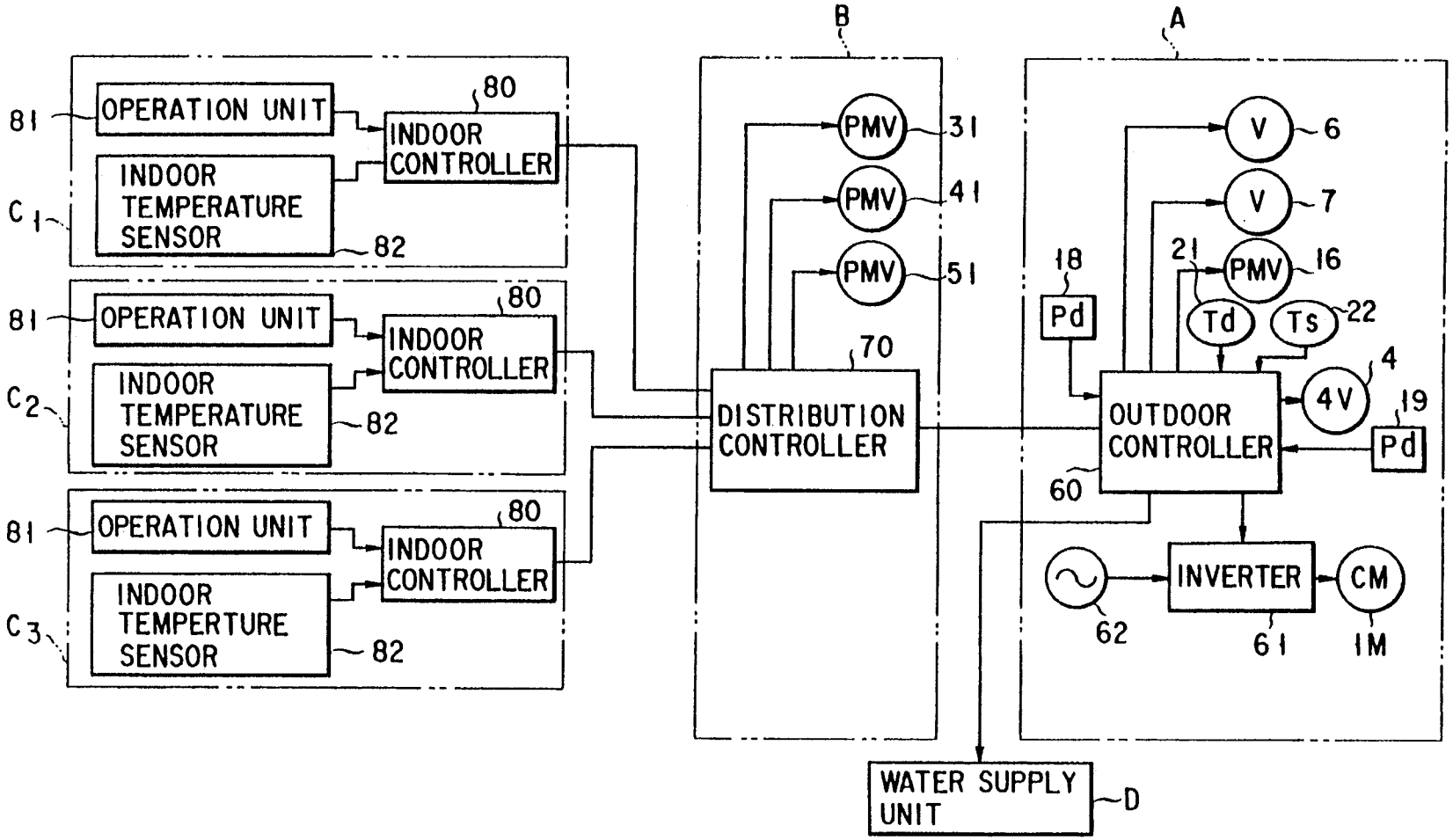
FIG. 2 is a block diagram of a control circuit according to the embodiment.

FIG. 2 shows a control circuit.

The outdoor unit A has a outdoor controller 60 comprising a microcomputer and peripheral circuits. The controller 60 is connected to the four-way valve 4, two-way valves 6, 7, PMV 16, high-pressure switch 18, pressure sensor 19, temperature sensors 21, 22 and inverter 61.

The inverter 61 rectifies the voltage of a commercial AC power source 62 and converts the voltage to a voltage having a frequency and level set by a command from the outdoor controller 60. The output voltage of the inverter 61 actuates the compressor 1.

The outdoor controller 60 is connected to a distribution controller 70 of the distribution unit B and the water supply unit D via signal lines. The distribution controller 70 comprises a microcomputer and its peripheral circuits. The distribution controller 70 is connected to the PMVs 31, 41 and 51.

The distribution controller 70 is connected to indoor controllers 80 of the indoor units $C_1$, $C_2$ and $C_3$ via signal lines. Each indoor controller 80 comprises a microcomputer and its peripheral circuits. The indoor controllers 80 are connected to operation units 81 and indoor temperature sensors 82, respectively. The indoor temperature sensors 82 sense indoor temperatures.

On the other hand, each indoor controller 80 has the following functional means:

[1] means for sending to the distribution unit an operation start command and an operation stop command on the basis of the operation of the operation unit 81;

[2] means for sending to the distribution unit B a cooling operation mode request or a heating operation mode request set by the operation unit 81;

[3] means for finding, as an air-conditioning load, the difference between the indoor temperature set by the operation unit 81 and the sensed temperature of the indoor temperature sensor 82; and

[4] means for telling the found air-conditioning load to the distribution unit B.

The distribution controller 70 has the following functional means:

[1] means for determining one of the cooling operation mode and heating operation mode in accordance with requests from the indoor units $C_1$, $C_2$ and $C_3$;

[2] means for telling the determined operation mode to the outdoor controller 60;

[3] means for totally closing the PMV(s), among the PMVs 21, 31 and 41, which is(are) associated with the indoor unit(s) which has(have) issued the heating operation mode request(s), when the cooling operation mode is determined;

[4] means for controlling the opening degree(s) of the PMV(s), among the PMBs 21, 31 and 41, which is(are) associated with the indoor unit(s) which has(have) issued the cooling operation mode request(s), in accordance with the air-conditioning load of this(these) PMV(s), when the cooling operation mode is determined;

[5] means for finding the total air-conditioning load of the indoor unit(s) which has(have) issued the cooling operation mode request(s), when the cooling operation mode is determined;

[6] means for totally opening the PMV(s), among the PMVs 21, 31 and 41, which is(are) associated with the indoor unit(s) which has(have) issued the cooling operation mode request(s);

[7] means for controlling the opening degree(s) of the PMV(s), among the PMVs 21, 31 and 41, which is(are) associated with the indoor unit(s) which has(have) issued the heating operation mode request(s), in accordance with the air-conditioning load of this(these) PMV(s), when the heating operation mode is determined;

[8] means for finding the total air-conditioning load of the indoor unit(s) which has(have) issued the heating operation mode request(s), when the heating operation mode is determined; and

[9] means for telling the found total air-conditioning load to the outdoor unit A.

The outdoor controller 60 has the following functional means:

[1] means for starting the operation of the compressor 1 by driving the inverter 61 and starting the operation of the water supply unit D, in response to the operation start command;

[2] means for controlling the frequency F(Hz) of the output voltage of the inverter 61 in accordance wit the total air-conditioning load;

[3] means for setting the four-way valve 4 in the neutral position, without supplying electric power to the four-way valve 4, when the cooling operation mode is determined;

[4] means for supplying electric power to the four-way valve 4 and switching the four-way valve 4, when the cooling operation mode is determined;

[5] high-pressure protection means for stopping the operation of the compressor 1, when the high-pressure switch 18 is operated;

[6] means for controlling the opening/closing of the two-way valves 6 and 7 in accordance with the high-pressure-side pressure Pd sensed by the pressure sensor 19;

[7] suction-temperature protection means for stopping the operation of the compressor 1 when the temperature Ts of the sucked refrigerant, sensed by the temperature sensor 22, increases and exceeds a predetermined value (40° C.) for a predetermined time period;

[8] means for zone-controlling the opening degree of the PMV 16 in accordance with either the discharged-refrigerant temperature Td sensed by the temperature sensor 21 or the sucked-refrigerant temperature Ts sensed by the temperature sensor 22;

[9] means for adjusting the opening degree of the PMV 16 so as to increase the opening degree of the PMV 16, irrespective of the zone control, when the sucked-refrigerant temperature Ts exceeds a preset value, e.g. 25° C; and

[10] means for stopping the operation of the inverter 61, stopping the operation of the compressor 1 and stopping the operation of the water supply unit D in response to the operation stop command.

The operation of the invention will now be described.

Figure 3:
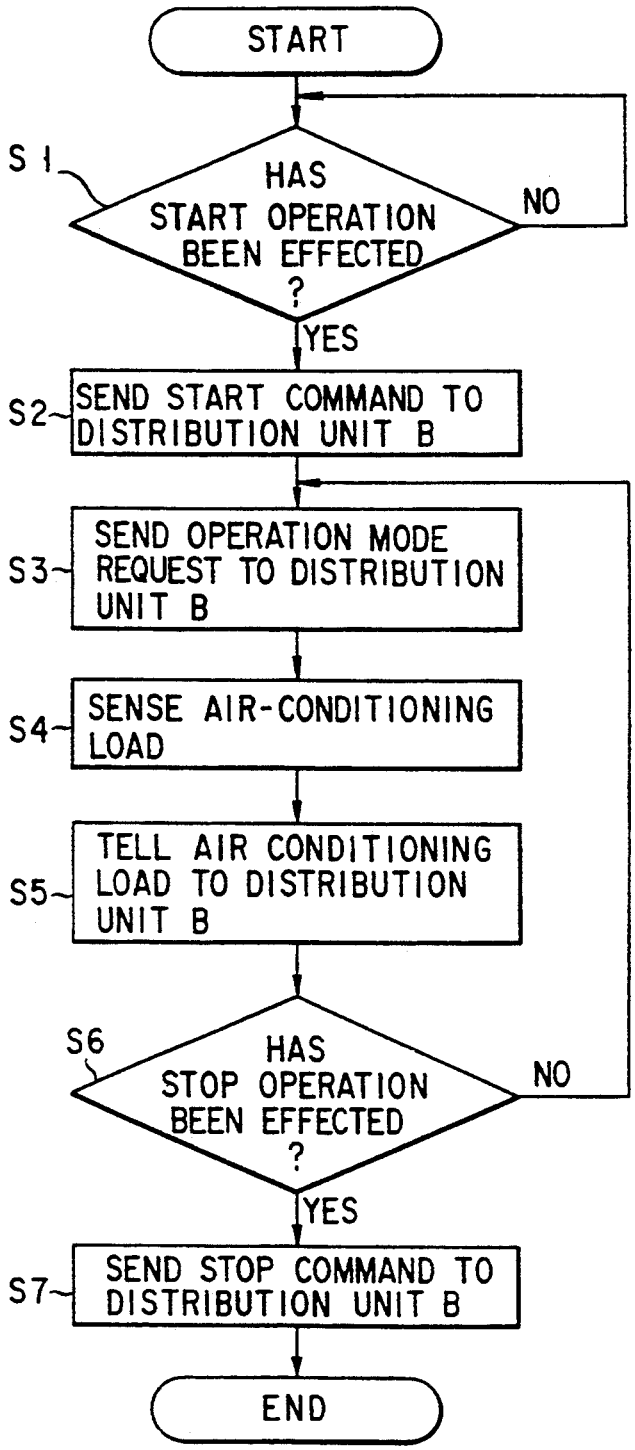
FIG. 3 is a flow chart for illustrating the operation of an indoor control section according to the embodiment.

The operation of the indoor units $C_1$, $C_2$ and $C_3$ will now be described with reference to FIG. 3.

When the start operation is effected by the operation unit 81 (step S1), the operation start command is sent to the distribution unit B (step S2). Simultaneously, the cooling operation mode request or heating operation mode request set by the operation unit 81 is sent to the distribution unit B (step S3).

A difference between the set indoor temperature set by the operation unit 81 and the sensed temperature of the indoor temperature sensor 82 is found as an air-conditioning load (step S4). The found air-conditioning load is told to the distribution unit B (step S5). When the stop operation is effected by the operation unit 81 (step S6), the operation stop command is sent to the distribution unit B (step S7).

Figure 4A:
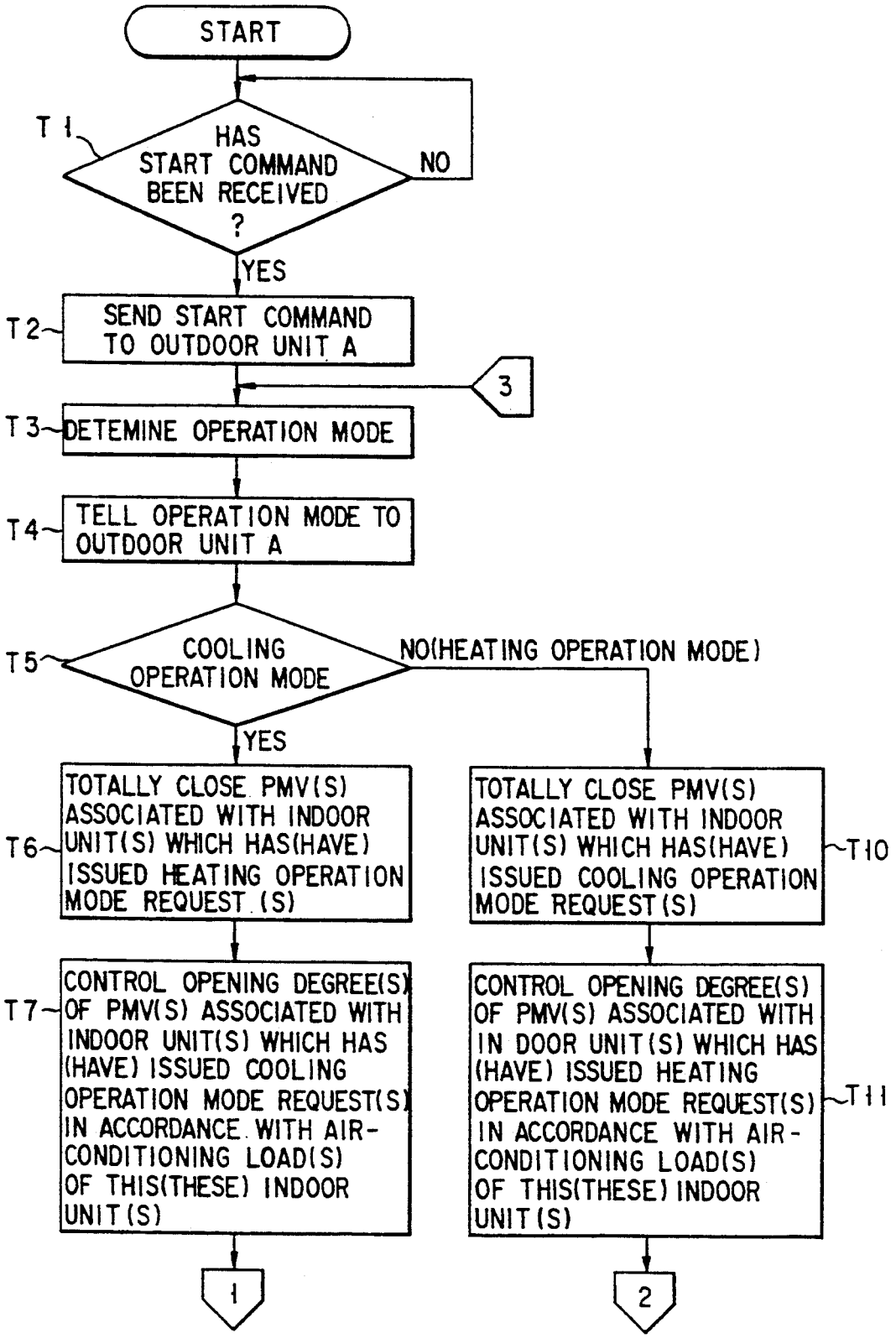
FIG. 4A and FIG. 4B are flow charts for illustrating the operation of a distribution control section according to the embodiment.
Figure 4B:
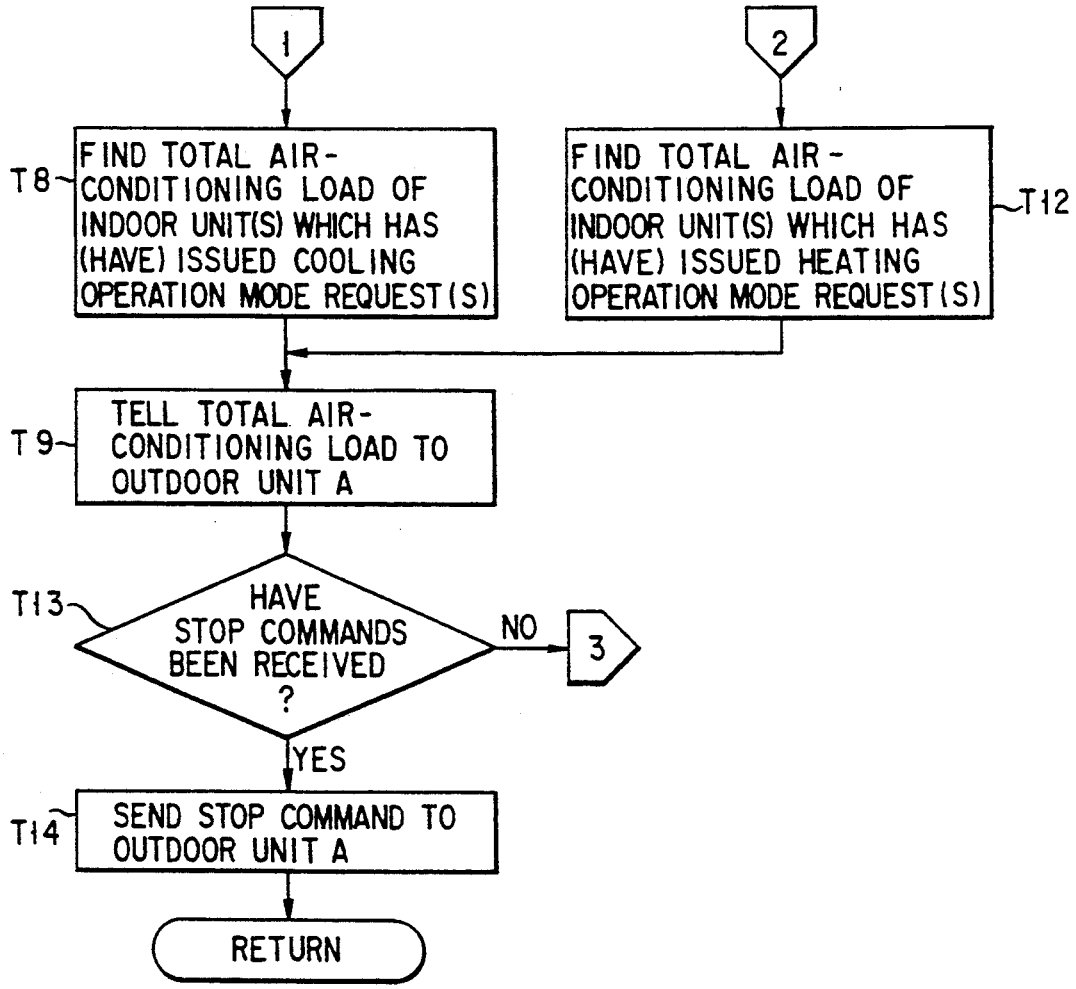

The operation of the distribution unit B will now be described with reference to FIGS. 4A, 4B and 4C.

When a start command is sent from at least one of the indoor units $C_1$, $C_2$ and $C_3$ (step T1), the operation start command is sent to the outdoor unit A (step T2). Simultaneously, in accordance with the requests from the indoor units $C_1$, $C_2$ and $C_3$, either the cooling operation mode or heating operation mode is determined (step T3).

For example, the number of cooling operation mode requests is compared with the number of heating operation mode requests, thereby determining the operation mode. Alternatively, the order of priority is determined, in advance, on the indoor units $C_1$, $C_2$ and $C_3$, and the operation mode requested by the highest-priority indoor unit is selected and determined. The determined operation mode is told to the outdoor control unit 60 (step T4).

When the cooling operation mode is determined (step T5), the PMV(s) 31, 41, 51 associated with the indoor unit(s) which has(have) issued heating operation mode request(s) are totally closed (step T6). Simultaneously, the opening degree(s) of the PMV(s) 31, 41, 51 associated with the indoor unit(s) which has(have) issued cooling operation mode request(s) are controlled in accordance with the air-conditioning load(s) of this(-these) indoor unit(s) (step T7).

The total air-conditioning load of the indoor unit(s) which has(have) issued cooling operation mode request(s) is found (step T8). The found total air-conditioning load is told to the outdoor unit A (step T9).

When the heating operation mode is determined (step T5), the PMV(s) 31, 41, 51 associated with the indoor unit(s) which has(have) issued cooling operation mode request(s) are totally closed (step T10). Simultaneously, the opening degree(s) of the PMV(s) 31, 41, 51 associated with the indoor unit(s) which has(have) issued heating operation mode request(s) are controlled in accordance with the air-conditioning load(s) of this(-these) indoor unit(s) (step T11).

The total air-conditioning load of the indoor unit(s) which has(have) issued heating operation mode request(s) is found (step T12). The found total air-conditioning load is told to the outdoor unit A (step T9).

When stop commands are sent from all indoor units $C_1$, $C_2$ and $C_3$ (step T13), a stop command is sent to the outdoor unit A (step T14).

Figure 5A:
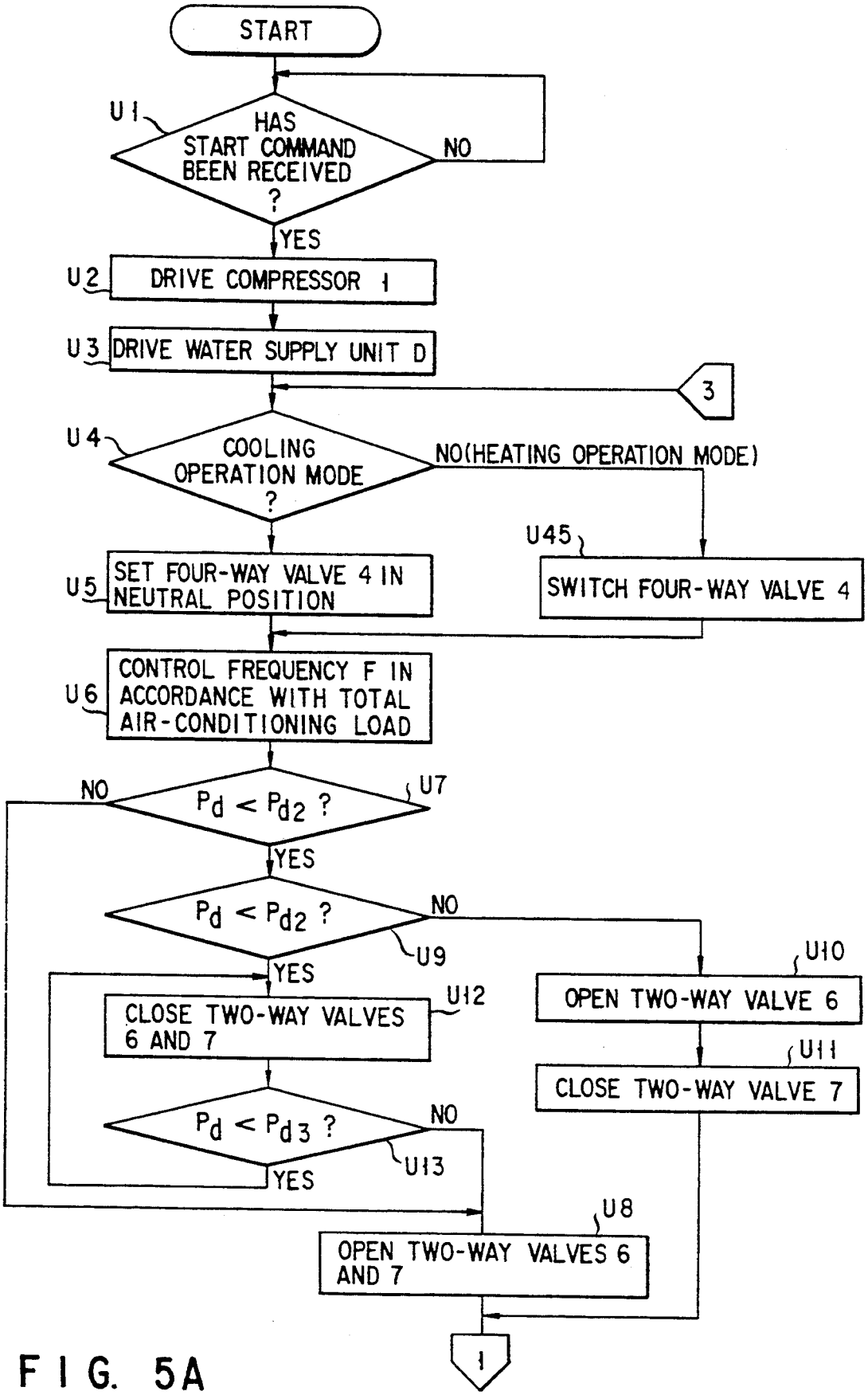
FIG. 5A, FIG. 5B and FIG. 5C are flow charts for illustrating the operation of an outdoor control section according to the embodiment.
Figure 5B:
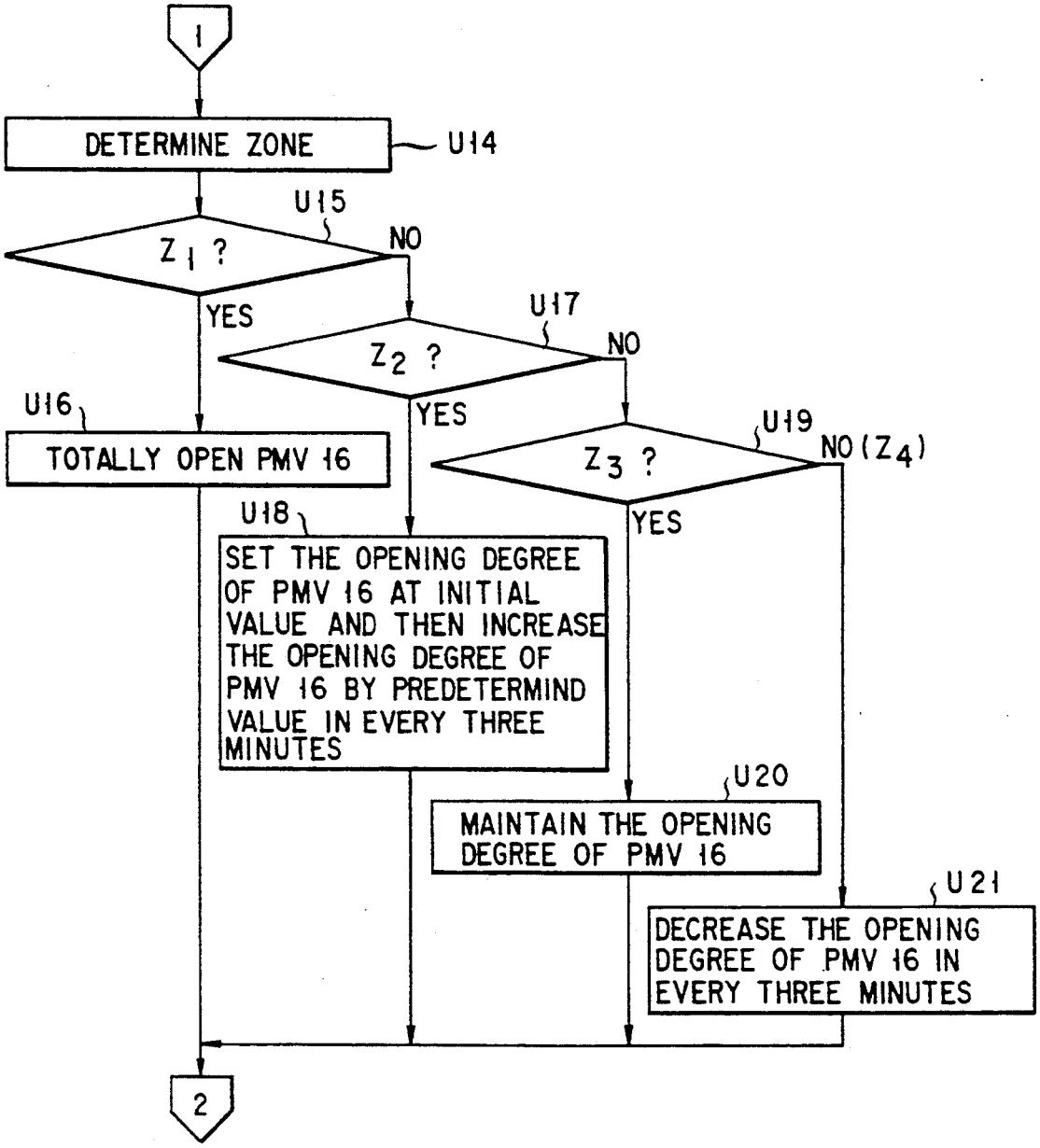
Figure 5C:
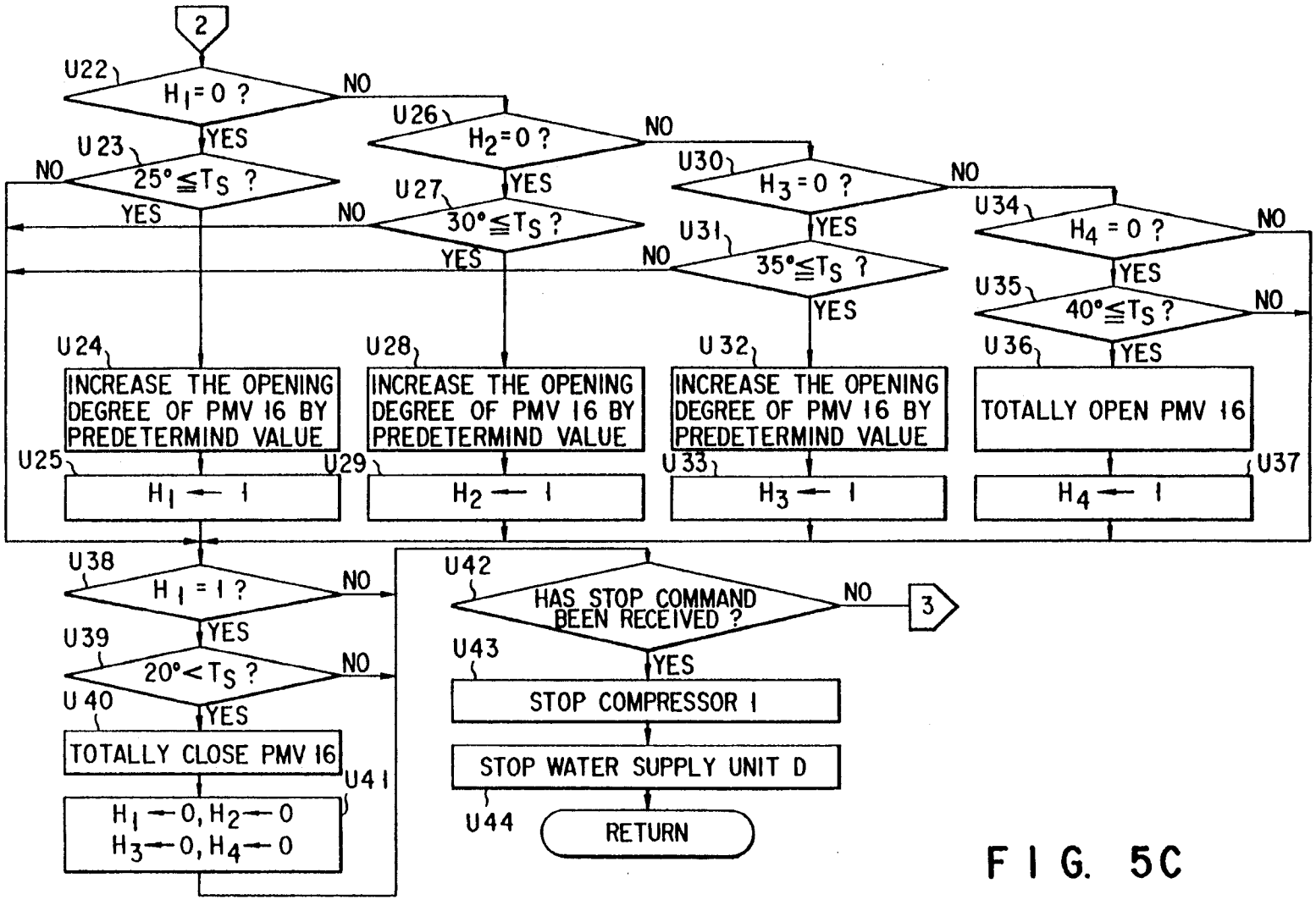

The operation of the outdoor unit A will now be described with reference to FIGS. 5A, 5B and 5C.

When a start command is sent from the distribution unit B (step U1), the inverter 61 is driven, the operation of the compressor 1 is driven (step U2) and the water supply unit D is driven (step U3).

When the cooling operation mode request is issued (step U4), the four-way valve 4 is set in the neutral position (step U5).

In this case, as shown in FIG. 1 by solid-line arrows, a refrigerant is discharged from the compressor 1 and supplied to the water heat exchangers 5*a*, 5*b* and 5*c* via the four-way valve 4. The heat of the refrigerant supplied to the water heat exchangers 5*a*, 5*b* and 5*c* is absorbed by water supplied from the water supply unit D and liquefied.

The liquid refrigerant coming from the water heat exchangers 5*a*, 5*b* and 5*c* flows through the check valve 8 and receiver 10 and passes through the PMV(s), 31, 41, 51 which is(are) opened.

Suppose that the PMVs 31 and 41 are opened and the PMV 51 is totally closed.

The pressure of liquid refrigerant, which has passed through the PMVs 31 and 41 is decreased by the expansion valves 32 and 42, and the refrigerant enters the indoor heat exchangers 34 and 44. The refrigerant in the indoor heat exchangers 34 and 44 absorbs heat from the indoor air and evaporates. The gas-phase refrigerant coming out of the indoor heat exchangers 34 and 44 is sucked in the compressor 1 via the four-way valve 4 and accumulator 11.

The water heat exchangers 5*a*, 5*b* and 5*c* function as condensers, and the indoor heat exchangers 34 and 44 function as evaporators, so that the rooms equipped with the indoor units $C_1$ and $C_2$ are cooled.

In the cooling operation mode, the frequency F(Hz) of the output voltage of inverter 61 is set in accordance with the total air-conditioning load (step U6). Specifically, the compressor 1 exhibits a performance matching with the cooling load of the rooms equipped with the indoor units $C_1$ and $C_2$.

The high-pressure-side pressure Pd sensed by the pressure sensor 19 is compared with the set value $Pd_2$ (step U7). If the number of driven indoor units $C_1$, $C_2$, $C_3$ is two or more, the pressure Pd is greater than the set value $Pd_2$ ($Pd > Pd_2$) At this time, both two-way valves 6 and 7 are opened (step U8). When the two-way valves 6 and 7 are opened, the refrigerant passes through all water heat exchangers 5*a*, 5*b* and 5*c* and a maximum condensation performance is attained.

When the driving mode is changed so that only one of the indoor units $C_1$, $C_2$ and $C_3$ is driven, the condensation performance becomes excessive and the high-pressure-side pressure Pd decreases. When the high-pressure-side pressure Pd becomes lower than the set value $Pd_2$ ($Pd < Pd_2$), the high-pressure-side pressure Pd is compared with the set value $Pd_1$ ($< Pd_2$) (step U9).

If the high-pressure-side pressure Pd is greater than the set value $Pd_1$ ($Pd_2 > Pd > Pd_1$), the two-way valve 6 is opened (step U10) and the two-way valve 7 is closed (step U11). Once the two-way valve 6 is opened and the two-way valve 7 is closed, the refrigerant passes through the two water heat exchangers 5a and 5b but does not pass through the water heat exchanger 5c. In this case, the condensation performance is at a middle level.

If the high-pressure-side pressure Pd further decreases and becomes less than the set value $Pd_1$ ($Pd < Pd_1$), both two-way valves 6 and 7 are closed (step U12). Once the two-way valves 6 and 7 are closed, the refrigerant passes through only the water heat exchanger 5a and does not pass through the water heat exchanger 5b or 5c. That is, the condensation performance is at a minimum level.

At this time, the high-pressure-side pressure Pd is compared with the set value $Pd_3$ ($> Pd_2$) (step U13). If the pressure Pd is lower than the set value $Pd_3$ ($Pd < Pd_3$), the two-way valves 6 and 7 are left closed. (step U13).

When the number of driven indoor units $C_1$, $C_2$, $C_3$ is increased, the condensation performance becomes insufficient, and the high-pressure-side pressure Pd increases. When the pressure Pd exceeds the set value $Pd_3$ ($Pd > Pd_3$), both two-way valves 6 and 7 are opened (step U8).

As described above, since the water heat exchangers 5a, 5b and 5c are selectively operated, the excessive increase in condensation performance is prevented and a sufficient high-pressure-side pressure Pd is maintained.

On the other hand, if the heating operation mode is requested ("No" in step U4), the four-way valve 2 is switched (step U45). Suppose that the PMVs 31 and 41 are opened and the PMV 51 is totally closed.

As shown in FIG. 1 by broken-line arrows, the refrigerant discharged from the compressor 1 enters the indoor heat exchangers 34 and 44 via the four-way valve 4. The heat of the refrigerant in the indoor heat exchangers 34 and 44 is absorbed by the indoor air, and the refrigerant is liquefied. The liquid refrigerant coming out of the indoor heat exchangers 34 and 44 flows through the check valves 33 and 43, PMVs 31 and 41, receiver 10 and expansion valve 9, and enters the water heat exchangers 5a, 5b and 5c.

The refrigerant in the water heat exchangers 5a, 5b and 5c absorbs heat from the water supplied from the water supply unit D and evaporates. The gas refrigerant coming out of the water heat exchangers 5a, 5b and 5c flows through the four-way valve 4 and accumulator 11 and is sucked in the compressor 1.

In this case, the indoor heat exchangers 34 and 44 function as condensers and the water heat exchangers 5a, 5b and 5c function as evaporator, so that the rooms equipped with the indoor units $C_1$ and $C_2$ are heated.

In the heating operation mode, the frequency F(Hz) of the output voltage of inverter 61 is set in accordance with the total air-conditioning load (step U6). Specifically, the compressor 1 exhibits a performance matching with the heating load of the rooms equipped with the indoor units $C_1$ and $C_2$.

In the heating operation mode, too, the high-pressure-side pressure Pd sensed by the pressure sensor 19 is compared with the set values $Pd_1$, $Pd_2$ and $Pd_3$. On the basis of the comparison result, the opening/closing of the two-way valves 6 and 7 is controlled. Thereby, the water heat exchangers 5a, 5b and 5c are selectively operated, the excessive increase in condensation performance is prevented and a sufficient high-pressure-side pressure Pd is maintained. The set values $Pd_1$, $Pd_2$ and $Pd_3$ are different between the cooling operation mode and the heating operation mode.

In the heating operation mode, the opening degree of the expansion valve 9 varies in accordance with the difference between the temperature of the refrigerant flowing in the expansion valve 9 (i.e. the temperature of the refrigerant flowing into the water heat exchangers 5a, 5b and 5c) and the sensed temperature of the temperature sensing portion 9a. The opening degree varies to control the flow rate of the refrigerant flowing to the water heat exchangers 5a, 5b and 5c. Thereby, the excessive heating degree of the refrigerant in the water heat exchangers 5a, 5b and 5c is kept constant.

In the cooling operation mode and heating operation mode, the temperature Ts of the refrigerant discharged from the compressor 1 is sensed by the temperature sensor 21, and the temperature Ts of the refrigerant sucked in the compressor 1 is sensed by the temperature sensor 22.

Figure 6:
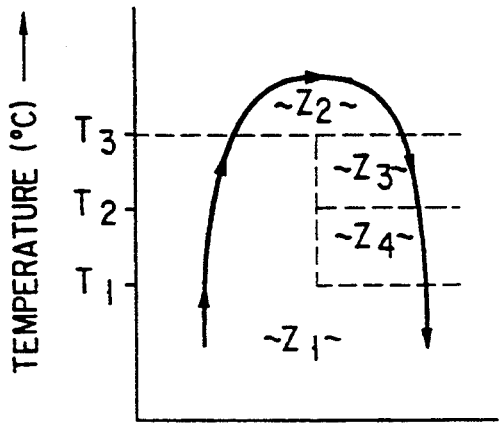
FIG. 6 illustrates the zone control condition according to the embodiment.

The zone control conditions shown in FIG. 6 are set for the sensed temperatures Td and Ts. Specifically, four zones $Z_1$, $Z_2$, $Z_3$ and $Z_4$ are determined on the basis of the set temperatures $T_1$, $T_2$ and $T_3$. The control based on zones $Z_1$ and $Z_2$ is executed when either the sensed temperature Td or Ts increases, and the control based on zones $Z_3$ and $Z_4$ is executed when either the sensed temperature Td or Ts decreases.

First, it is determined to which zone $Z_1$, $Z_2$, $Z_3$, $Z_4$ the sensed temperature Td, Ts corresponds (step U14).

When both sensed temperatures Td and Ts correspond to the zone $Z_1$ (step U15), the PMV 16 is totally closed (step U16).

When either sensed temperature Td or Ts falls in the zone $Z_2$ (step U17), the opening degree of the PMV 16 is set at an initial value and then the opening degree of the PMV 16 is increased by a predetermined value in every three minutes (step U18).

When the sensed temperature Td or Ts in zone $Z_2$ decreases down to zone $Z_3$ (step U19), the opening degree of the PMV 16 at that time is maintained (Step U20).

When the sensed temperature Td or Ts in zone $Z_3$ decreases down to zone $Z_4$ ("No" in step U19), the opening degree of the PMV 16 is decreased by a predetermined value in every three minutes (Step U21).

When the sensed temperature Td or Ts in zone $Z_4$ decreases down to zone $Z_1$ (step U15), the PMv 16 is totally closed (step U16).

The opening degree of the PMV 16 corresponds to "40" to "60" which is the number of driver pulses. The number of pulses is preset on the basis of the scale of the refrigerating cycle, etc.

The predetermined value, by which the opening degree of the PMV 16 is increased, corresponds to the number of pulses of "10" to "40". This number of pulses is preset on the basis of the frequency F(Hz) of the output voltage of the inverter 61, the scale of the refrigerating cycle, etc.

The predetermined value, by which the opening degree of the PMV 16 is decreased, corresponds to the number of pulses of "10" to "30". This number of pulses is preset on the basis of the frequency F(Hz) of the output voltage of the inverter 61, the scale of the refrigerating cycle, etc.

The values of the set temperatures $T_1$, $T_2$ and $T_3$ relating to the discharged-refrigerant temperature Td are different from those relating to the sucked-refrigerant temperature Ts, as shown in the following table:

| | $T_s$ | $T_d$ | |
|---|---|---|---|
| | | $F_5$ or above | $F_3$, $F_4$ |
| $T_3$ | 20° C. | 110° C. | 100° C. |
| $T_2$ | 17° C. | 100° C. | 90° C. |
| $T_1$ | 14° C. | 90° C. | 70° C. |

The values $F_3$, $F_4$ and $F_5$ indicate the frequency F of the output voltage of the inverter 61, and these values have the relationship: $F_3<F_4<F_5$.

When the PMV 16 is opened by the above zone control, part of the liquid refrigerant flowing in the liquid line W enters the bypass 15. The liquid refrigerant in the bypass 15 joins the refrigerant flowing from the four-way valve 4 to the accumulator 11. Thereby, the sucked-refrigerant temperature Ts of the compressor 1 decreases. In accordance with the decrease in temperature Ts, the discharged-refrigerant temperature Td decreases.

Suppose that the high-pressure-side pressure Pd has increased. In this case, the discharged-refrigerant temperature Td also increases. Thus, the above zone control is executed. By the zone control, the increase in temperature Td is suppressed, and consequently an abnormal increase in high-pressure-side pressure Pd is prevented. Thus, before the high-pressure switch 18 is operated, abnormal increase of the high-pressure side pressure Pd can be prevented as much as possible, and the operation of the apparatus can be continued without interruption. Therefore, the comfortable air-conditioning can be achieved.

The multiple air-conditioning apparatus is provided with two or more indoor units. Thus, in the cooling operation mode, the temperature of the refrigerant returning from each indoor unit to the heat source unit tends to increase. In particular, when the air-conditioning load is large, the temperature of the refrigerant sucked in the compressor may reach 40° C. If such high-temperature refrigerant is continuously sucked in the compressor, the compressor may be damaged.

In connection with the increase in sucked-refrigerant temperature Td, the zone control is executed as in the case of the increase in high-pressure-side pressure Pd. However, despite the zone control, the increase in sucked-refrigerant temperature Td may continue for the above reason.

In order to solve this problem, the control from step U22 to step U41 is executed. In this control, flags $H_1$, $H_2$, $H_3$ and $H_4$ are used. These flags are prepared for the microcomputer of the control unit 60. If flag H1 is "0" (step U22), the sucked-refrigerant temperature Ts is compared with the set value 25° C. (step U23).

When the sucked-refrigerant temperature Ts reaches 25° C. or above, the opening degree of the PMV 16, which has already been opened by the zone control, is increased by a predetermined value (step U24). This predetermined value corresponds to the number of driver pulses of "50". Then, flag H1 is set to "1" (step U25).

There is no problem if the sucked-refrigerant temperature Ts is decreased by the increase in opening degree. However, there may be a case where the temperature Ts continues to further increase, despite the increase in opening degree. In this case, flag H1 is "1" (step U22) and flag H2 is "0" (step U26). Thus, the sucked-refrigerant temperature Ts is compared with the set value 30° C. (step U27).

When the sucked-refrigerant temperature Td reaches 30° C. or above, the opening degree of the PMV 16 is further increased by a predetermined value (step U28). This predetermined value corresponds to the number of driver pulses of "50". Then, flag $H_2$ is set to "1" (step U29).

Despite the increase in opening degree, the sucked-refrigerant temperature Ts may further increase. In this case, since flag $H_2$ is "1" (step U26) and flag $H_3$ is "0" (step U30), the temperature Ts is compared with the set value 35° C. (step U31).

When the sucked-refrigerant temperature Td reaches 35° C. or above, the opening degree of the PMV 16 is further increased by a predetermined value (step U32). This predetermined value corresponds to the number of driver pulses of "50". Then, flag $H_3$ is set to "1" (step U33).

Despite the increase in opening degree, the sucked-refrigerant temperature Ts may further increase. In this case, since flag $H_3$ is "1" (step U30) and flag $H_4$ is "0" (step U34), the temperature Ts is then compared with the set value 40° C. (step U35).

When the temperature Td reaches 40° C. or above, the PMV 16 is totally opened (step U36), and flag $H_4$ is set to "1" (step U37). The total opening state of the PMV 16 corresponds to the number of driver pulses of "270".

Figure 7:
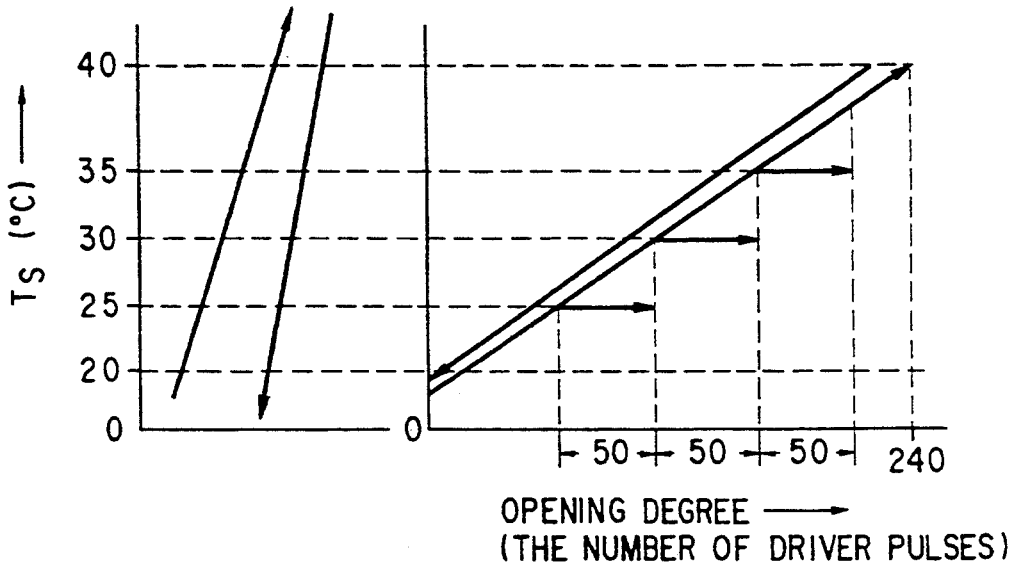
FIG. 7 is a graph showing the relationship between the temperature Td of sucked refrigerant and the opening degree of a flow control valve according to the embodiment.

FIG. 7 shows the relationship between the variation in sucked-refrigerant temperature Ts and the opening degree of the PMV 16.

The opening degree of the PMV 16 is controlled and increased, as described above. Thereby, the amount of refrigerant flowing through the bypass 15 increases and the cooling effect on the low-pressure-side refrigerant increases. When the cooling effect increases, flag $H_1$ is always set to "1".

When flag $H_1$ is "1" (step U38), the sucked-refrigerant temperature Ts is compared with the set value 20° C. (step U39).

When the temperature Ts decreases to 20° C., the PMV 16 is totally closed (step U40). Then, all flags $H_1$, $H_2$, $H_3$ and $H_4$ are set to "0" (step U41).

When the operation start command is issued frc .. the distribution unit B (step U42), the operation of the inverter 61 is stopped and the operation of the compressor 1 is stopped (step U43). In addition, the operation of the water supply unit D is stopped (step U44).

In the above embodiment, the water heat exchangers 5*a*, 5*b* and 5*c* are used as source-side heat exchangers. However, air heat exchangers may be used as source-side heat exchangers. Further, the two two-way valves 6 and are used to control the flow of refrigerant to the water heat exchangers 5*a*, 5*b* and 5*c*. The number of two-way valves is not limited and may be at least one.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air-conditioning apparatus wherein a plurality of indoor units are connected to a heat source unit, the apparatus comprising:

a compressor, provided in the heat source unit, for sucking and compressing a refrigerant and discharging the compressed refrigerant;

a heat-source-side heat exchanger provided in the heat source unit;

a plurality of indoor heat exchangers provided in the indoor units, respectively;

a refrigerating cycle constituted by connecting the compressor, the heat-source-side heat exchanger and the indoor heat exchangers by means of pipes;

a bypass extending from a pipe portion between the heat-source-side heat exchanger and the indoor heat exchangers of the refrigerating cycle to a low-pressure-side pipe portion of the refrigerating cycle;

a flow control valve having an opening degree varied to control the amount of the refrigerant flowing in the bypass;

first temperature sensing means for sensing the temperature of the refrigerant discharged from the compressor;

second temperature sensing means for sensing the temperature of the refrigerant sucked in the compressor;

first control means for controlling the opening degree of the flow control valve in accordance with one of the sensed temperature of the first temperature sensing means and the sensed temperature of the second temperature sensing means; and second control means for controlling the opening degree of the flow control valve by increasing the opening degree of the flow control valve, when the sensed temperature of the second temperature sensing means exceeds a predetermined value, despite the control by the first control means.

2. The apparatus according to claim 1, wherein the heat-source-side heat exchanger comprises a plurality of water heat exchangers.

3. The apparatus according to claim 2, further comprising a water supply unit for supplying water to the water heat exchangers.

4. The apparatus according to claim 2, wherein the water heat exchangers exchange heat of the incoming refrigerant with heat of the water supplied from the water supply unit.

5. The apparatus according to claim 2, further comprising:

at least one two-way valve for controlling the flow of the refrigerant to the water heat exchangers;

a pressure sensor for sensing the high-pressure-side pressure of the refrigerating cycle; and control means for controlling the opening degree of said at least one two-way valve in accordance with the sensed pressure of the pressure sensor.

6. The apparatus according to claim 1, further comprising:

a plurality of flow control valves for controlling the amount of the refrigerant flowing to the indoor heat exchangers;

air-conditioning load sensing means, provided in the indoor units, for sensing air-conditioning loads;

control means for controlling the performance of the compressor in accordance with the total of the air-conditioning load sensed by the air-conditioning load sensing means; and control means for controlling the opening degrees of the plurality of flow control valves in accordance with the sensed air-conditioning loads.

7. The apparatus according to claim 6, wherein the heat-source-side heat exchanger comprises a plurality of water heat exchangers.

8. The apparatus according to claim 7, further comprising a water supply unit for supplying water to the water heat exchangers.

9. The apparatus according to claim 7, wherein the water heat exchangers exchange heat of the incoming refrigerant with heat of the water supplied from the water supply unit.

10. The apparatus according to claim 7, further comprising:

at least one two-way valve for controlling the flow of the refrigerant to the water heat exchangers;

a pressure sensor for sensing the high-pressure-side pressure of the refrigerating cycle; and control means for controlling the opening degree of said at least one two-way valve in accordance with the sensed pressure of the pressure sensor.

* * * * *